US007255079B2

(12) United States Patent
Tripathy et al.

(10) Patent No.: US 7,255,079 B2
(45) Date of Patent: Aug. 14, 2007

(54) FLANGED COVER ASSEMBLY WITH FLANGE PRESSURE DISTRIBUTION COMPENSATOR

(75) Inventors: Bhawani S. Tripathy, Ann Arbor, MI (US); Brent R. Sedlar, Ypsilanti, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/251,950

(22) Filed: Oct. 17, 2005

(65) Prior Publication Data

US 2006/0144358 A1 Jul. 6, 2006

Related U.S. Application Data

(60) Provisional application No. 60/631,668, filed on Nov. 30, 2004, provisional application No. 60/619,865, filed on Oct. 18, 2004.

(51) Int. Cl.
*F01M 9/10* (2006.01)

(52) U.S. Cl. ..... 123/90.38; 123/195 C; 123/198 E; 267/36.1; 267/37.1; 403/274; 403/276

(58) Field of Classification Search ..... 123/90.38
See application file for complete search history.

(56) References Cited

U.S. PATENT DOCUMENTS

| | | | | |
|---|---|---|---|---|
| 2,877,756 A | | 3/1959 | McCouley et al. | |
| 4,067,531 A | | 1/1978 | Sikula | |
| 4,394,853 A | | 7/1983 | Lopez-Crevillen et al. | |
| 4,456,268 A | | 6/1984 | Penn et al. | |
| 4,492,189 A | | 1/1985 | Ogawa et al. | |
| 4,522,165 A | | 6/1985 | Ogawa | |
| 4,548,170 A | | 10/1985 | Forsthuber et al. | |
| 4,821,699 A | | 4/1989 | Mackin | |
| 4,881,595 A | * | 11/1989 | Damsohn et al. | 165/173 |
| 4,997,193 A | | 3/1991 | Czernik | |
| 5,365,901 A | * | 11/1994 | Kiczek | 123/195 C |
| 5,639,103 A | | 6/1997 | Jeanne et al. | |
| 5,655,489 A | * | 8/1997 | Kammerer et al. | 123/90.38 |
| 6,834,741 B2 | * | 12/2004 | Miller et al. | 180/313 |

* cited by examiner

*Primary Examiner*—Thomas Denion
*Assistant Examiner*—Kyle M. Riddle
(74) *Attorney, Agent, or Firm*—Robert Stearns; Dickinson Wright PLLC

(57) ABSTRACT

A flanged cover assembly includes a cover having a wall portion, a lateral attachment flange surrounding the wall portion extending outwardly therefrom and a plurality of spaced flange bores extending through the flange from a upper surface to a lower surface. The bores are adapted to receive a corresponding plurality of fasteners which are adapted to be inserted through the bores and secure the cover to a base. The invention also includes a spring retainer which is adapted to extend along at least a portion of the outer surface of the lateral attachment flange. The spring retainer has a plurality of spaced retainer bores corresponding to at least two of the spaced flange bores and at least one shaped spring portion that is adapted to contact the upper surface of the lateral attachment flange mediate the spaced flange bores. The assembly may also include a cover gasket having a plurality of bores corresponding to the plurality of spaced flange bores and spaced retainer bores. The shaped spring portion is adapted to apply a spring force to the lateral attachment flange when the fasteners are inserted through the plurality of spaced retainer bores and the plurality of spaced flange bores and used to secure the cover and the gasket to the base.

27 Claims, 7 Drawing Sheets

FLANGED COVER ASSEMBLY WITH FLANGE PRESSURE DISTRIBUTION COMPENSATOR

This invention claims priority to U.S. Provisional No. 60/619,865, filed Oct. 18, 2004 and U.S. Provisional No. 60/631,668, filed Nov. 30, 2004.

BACKGROUND OF THE INVENTION

1. Technical Field

The invention relates to flanged covers. More particularly, it relates to flanged valve covers for internal combustion engines having a retainer spring for distributing a closing force applied to the lateral attachment flange.

2. Related Art

Flanged covers are used in a wide variety of applications, particularly where the flange is used to provide a clamping force for sealing the cover to a base. Such covers include valve covers, which are conventionally made of a light weight mild steel sheet material, and together with a seals or gaskets serve to provide sealed enclosures, for the valve lifters, rocker arms and valves in the cylinder heads of internal combustion engines. Depending upon the type of engine there may be a single valve cover bolted to the engine head as in the case of an in-line engine or several valve covers in the case of a V-6, V-8, V-12 engines, each enclosing a bank of valves. Normally, a gasket or seal is disposed between the valve cover and the head to which it is bolted to prevent oil leakage. Valve covers have conventionally been formed from mild steel, but may also be molded from a variety of engineering plastics, including engineering thermoplastic or thermoset materials, in order to facilitate weight reduction, or the formation of covers having complex geometries, or combinations of the above.

Depending on the material used to form the valve cover and its thickness, particularly the thickness of the sealing flange, the cover, flange or both may, over a period of time, tend to warp and pull away somewhat from the head producing uneven clamping pressure on the gasket, which may in turn result in oil leaks. This warping can be caused by several conditions, including the uneven tightening or torquing of the bolts which secure the valve cover to the head, or by engine overheating, or due to creep or other deformation phenomena associated with the material selected for use in the valve cover. This problem can be exacerbated in plastic valve covers where creep and other deformation phenomena can be more pronounced, particularly at engine operating temperatures and in the regions which lie between or mediate the fasteners used to attach the valve cover, such as threaded bolts which are tightened into the cylinder head.

Therefore, improved cover assemblies, such as valve cover assemblies, are desired which provide improved clamping and closure characteristics and which reduce fluid leakage, such as oil leakage.

SUMMARY OF THE INVENTION

The present invention provides an improved cover assembly, such as valve cover assembly, which provides improved clamping and cover sealing and closure characteristics, and which reduces fluid leakage, such as oil leakage.

The cover assembly includes a lateral attachment flange and a retainer spring to compensate for uneven sealing forces and sealing pressures applied to the gasket seal by the means for applying the sealing force, such as a plurality of fasteners.

The present invention has the advantage of reducing or eliminating the tendency of the sealing flange to bend and/or creep when the sealing force is applied to the flange by compensating for the localized application of sealing forces by distributing the sealing force along the length of the flange as opposed to concentrating the sealing force in the regions of the flange closest to the points where the localized sealing force is applied (i.e., bolt locations). This results in a more uniform sealing force and pressure profile along the length of the sealing flange.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
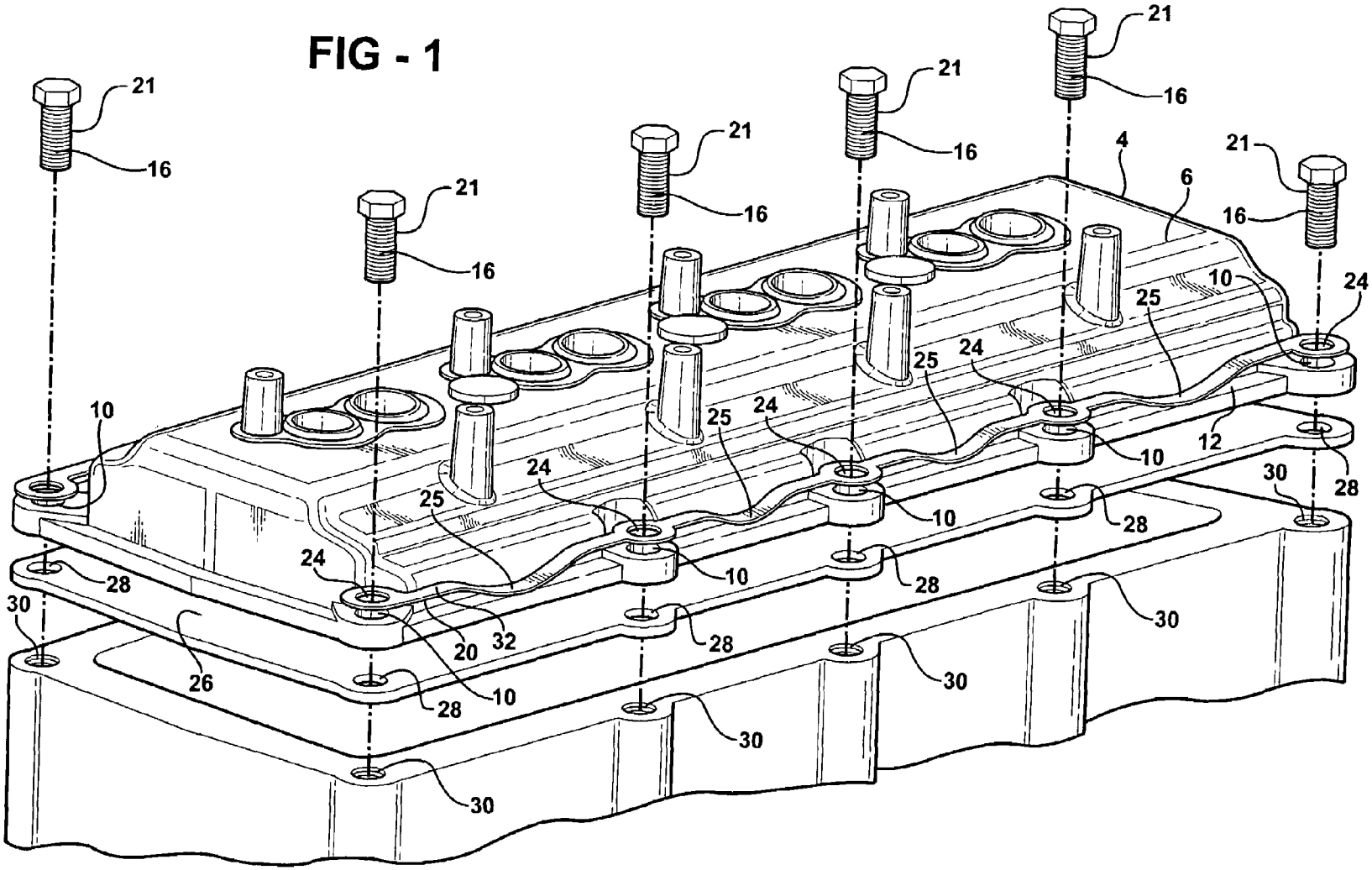
FIG. 1 is an exploded perspective view of flanged cover and spring retainer of the invention.
Figure 2:
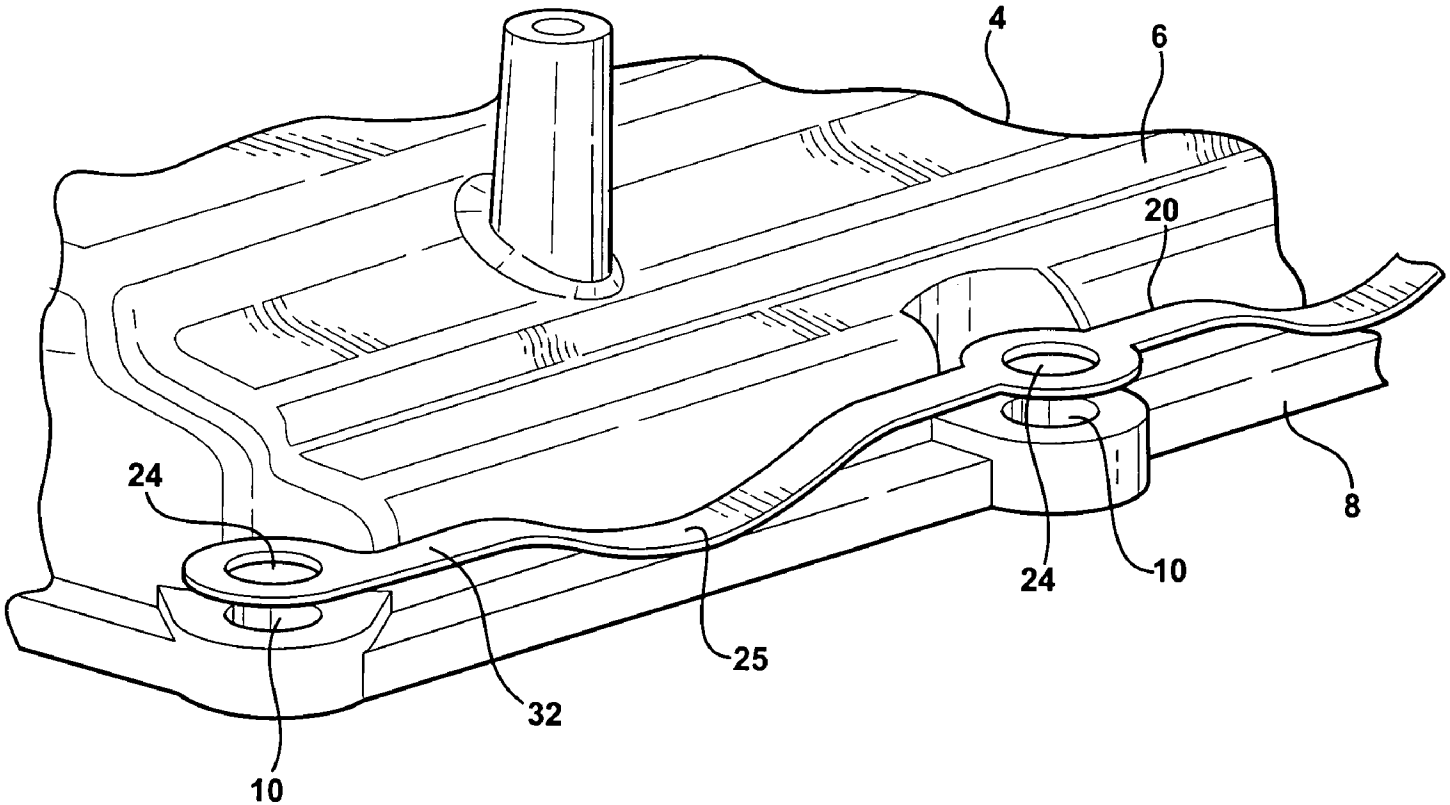
FIG. 2 is an enlargement of a portion of FIG. 1.

Referring to FIGS. 1, 2, 3A and 3B, one embodiment of a flanged cover assembly 2 of the present invention is illustrated. Flanged cover assembly includes a cover 4. Cover 4 has a wall portion 6 that is designed to cover or enclose a predetermined space, such as the space above the valves of an internal combustion engine which is enclosed by a valve cover. Wall portion 6 has a lateral attachment flange 8 which extends around its perimeter and extends outwardly therefrom. Lateral attachment flange 8 may include a plurality of spaced flange bores 10 which extend through the lateral attachment flange 8 from a upper surface 12 to a lower surface 14. Spaced flange bores 10 are adapted to receive a means for attaching 21 cover 4 to a base 18. The means for attaching 21 may compromise a plurality of fasteners 16 which correspond to the number of spaced flange bores and are adapted to be inserted through the plurality of bores 10 and secure the cover 4 to a base 18.

Figure 3A:
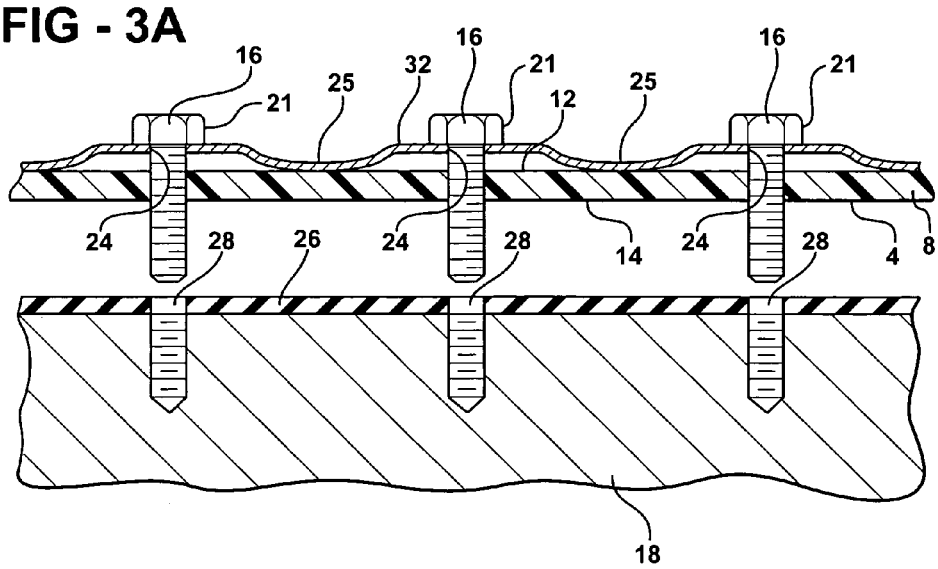
FIG. 3A is a partially exploded section view of the flanged cover and spring assembly of FIG. 1.
Figure 3B:
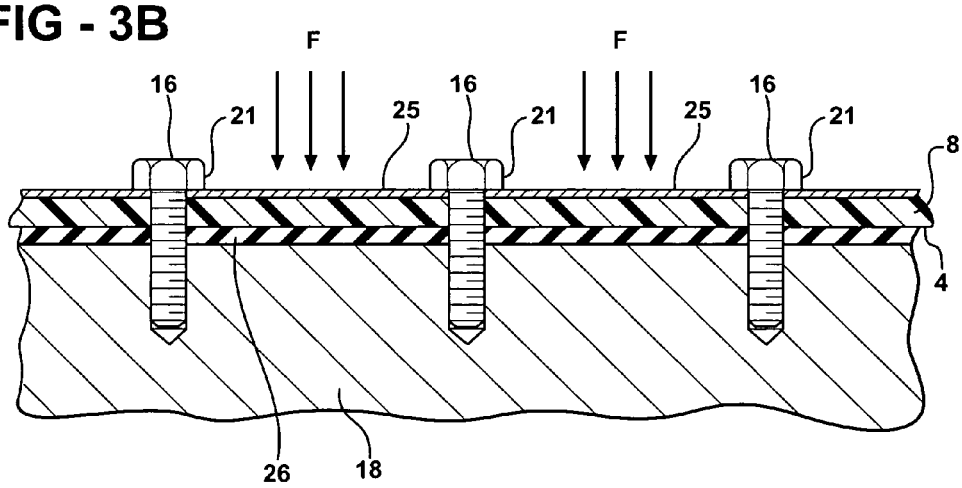
FIG. 3B is a assembled section view of the elements of FIG. 3A.

Cover assembly 2 may also include a spring retainer 20 which extends along at least a portion 22 of upper surface 12 of lateral attachment flange 8. Spring retainer 20 also may include a plurality of spaced retainer bores 24 corresponding to the spaced flange bores 10 and at least one shaped spring portion 25 that is adapted to contact upper surface 12 of the lateral attachment flange 8 mediate the spaced flange bores 10 and apply a spring force thereto. Cover assembly 2 also may include cover gasket 26. Cover gasket 26 also may include a plurality of gasket bores 28 corresponding to the plurality of spaced flange bores 10 and spaced retainer bores 24. The at least one shaped spring portion 25 is adapted to apply a spring force to the lateral flange, in this case at upper surface 12 of the lateral attachment flange 8, when a means for applying spring force 21 is applied to press the assembly together and form seal joint. Means for applying spring force 21 may include any suitable means, including various types of clamping mechanisms which may be applied to clamp the spring retainer 20 to the lateral attachment flange 8, and which may also be used clamp the spring retainer 20 and lateral attachment flange 8 to cover gasket 26 (if utilized) and base 18. The means may include one or more of various types of threaded and unthreaded fasteners, such as threaded bolts, screws and cam surface fasteners. In the case where cover 4 is a valve cover for an internal combustion engine, means for applying a spring force may comprise a plurality of threaded fasteners 16, such as threaded bolts, which are inserted through a plurality of spaced spring retainer bores 24 and the plurality of spaced flange bores 10 and tightened into a plurality of threaded bores 30 in the base 18, such as the cylinder head of the engine, as shown in FIG. 3A. As may be seen in FIG. 3B, as threaded bolts 16 are tightened into threaded bores 30, spring retainer 20 is pressed against the upper surface 12 of lateral attachment flange 8 thereby applying spring force to the flange in the region between or mediate spaced retainer bores 24. The magnitude of the spring force applied may be varied by appropriate design of the spring retainer, including factors which may affect the spring force applied by the curved spring sections, such as selection of the spring material (particularly the modulus of elasticity), the thickness of the spring section, the degree of curvature of the spring and other known factors affecting the spring force. The spring force may be selected to ensure the sealing engagement of the flange and gasket against the sealing surface of base, such that the seal joint does not leak over the entire operating temperature and pressure range of the sealed joint. The spring force may be selected to make the sealing pressure applied to the gasket more uniform around the perimeter of the sealed joint, particularly in the regions between the fasteners. The spring force may also be selected to apply sufficient force to reduce or eliminate warping of the lateral attachment flange which would or could otherwise occur in these regions.

The cover 4 may be formed from any suitable cover material, including various metals and plastics. If cover 4 is a metal, it preferably will have a high degree of castability or formability. Cover 4 may comprise an engineering plastic material, such as an engineering thermoplastic material or an engineering thermoset material. Examples include: acrylonitrile butadiene styrene (ABS), polyester, polyethylene (PEE), polyamide (PA), polyphenylene sulfide (PPS), polyphenylene ether (PPE), polybutylene terephthalate (PBT) polyethylene terephthalate (PET) and polyvinyl chloride. These may include both filled engineering plastics and unfilled engineering plastics as are well known. Cover 4 may be formed using conventional forming methods, such as casting, stamping and drawing in the case of metal covers, and injection molding in the case of plastic materials. Cover 4 may comprise a valve cover for covering and providing a sealed enclosure for the valve lifters, rocker arms and valves in the cylinder head of an internal combustion engine. Valve cover 4 is preferably formed from an engineering plastic material that has high temperature dimensional stability, chemical resistance and other well-known features associated with automotive underhood applications. In the case of valve cover 4, the cover may have a length (L) that is greater than the width (W), as illustrated in FIG. 1, and a wall portion 6 that also defines the depth of the enclosure. Wall portion 6 may include a lateral attachment flange 8 that extends laterally and outwardly from its periphery and is adapted for sealing engagement with gasket 26 or seal in order to seal cover 4 to base 18, such as a cylinder head. Cover 4, including wall portion 6 and lateral attachment flange 8, and gasket 26, may be of conventional design and construction.

The spring retainer 20 may be formed from any material with suitable physical properties, such as elastic modulus, that can be used to form a spring member. Examples of suitable materials include various forms of spring steel sheet and spring steel rod. Spring elements may be stamped and formed from spring steels sheet or bent or otherwise formed from spring steel rod. In the illustrated embodiment, spring member 20 comprises two spring elements 32, one which extends along the rear of cover 4 and the other which extends along the front of cover 4. Each element includes a plurality of curved spring portions 25 which are formed along its length. Spring retainer 20 may be formed as two elements 32 as shown, or as a single element which extends all the way around the perimeter of lateral attachment flange 8, or as more than two elements. The elements may be separate as shown in FIG. 1, or may be linked together as by connecting two elements with a single fastener.

Base 18 may be of conventional construction. Cover gasket 26 may also be of conventional construction. Means for attachment 21, such as fastener 16, may also be of conventional construction.

Figure 4A:
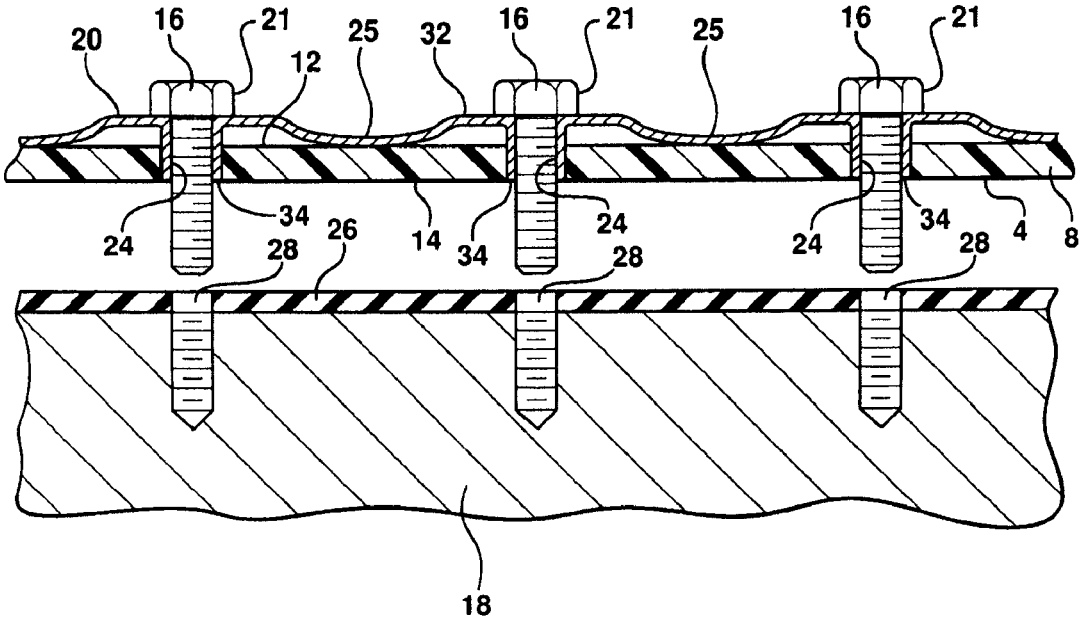
FIG. 4A is a partially exploded section view of a second embodiment of the flanged cover and spring assembly of the present invention.
Figure 4B:
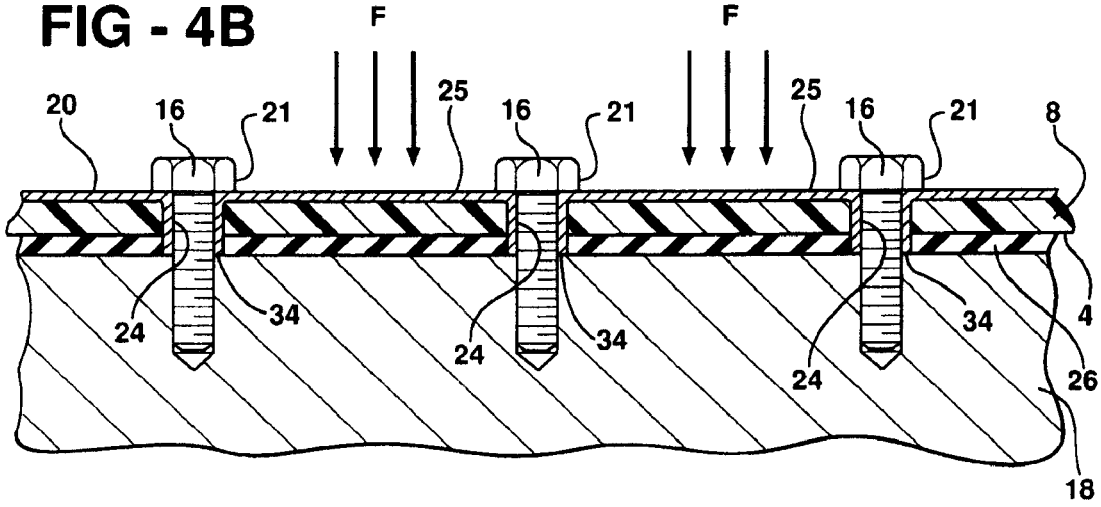
FIG. 4B is an assembled section view of the elements of FIG. 4A.

FIGS. 4A and 4B illustrate a second embodiment of the invention. FIG. 4A shows the cover assembly elements in the unassembled condition. FIG. 4B shows the cover assembly elements in the assembled condition. The embodiment is similar to the first embodiment, but includes a different construction of spring element 20. In this embodiment, spring element 20 includes a travel stop, drive stop or limiter 34. The height of travel stop 34 can be selected so as to prevent fastener 16 from being overtightened and damaging spring element 20, attachment flange 8 or cover gasket 26. Flange bores 10 and cover gasket bores 28 may also be adapted to receive the travel stop 34.

Figure 5A:
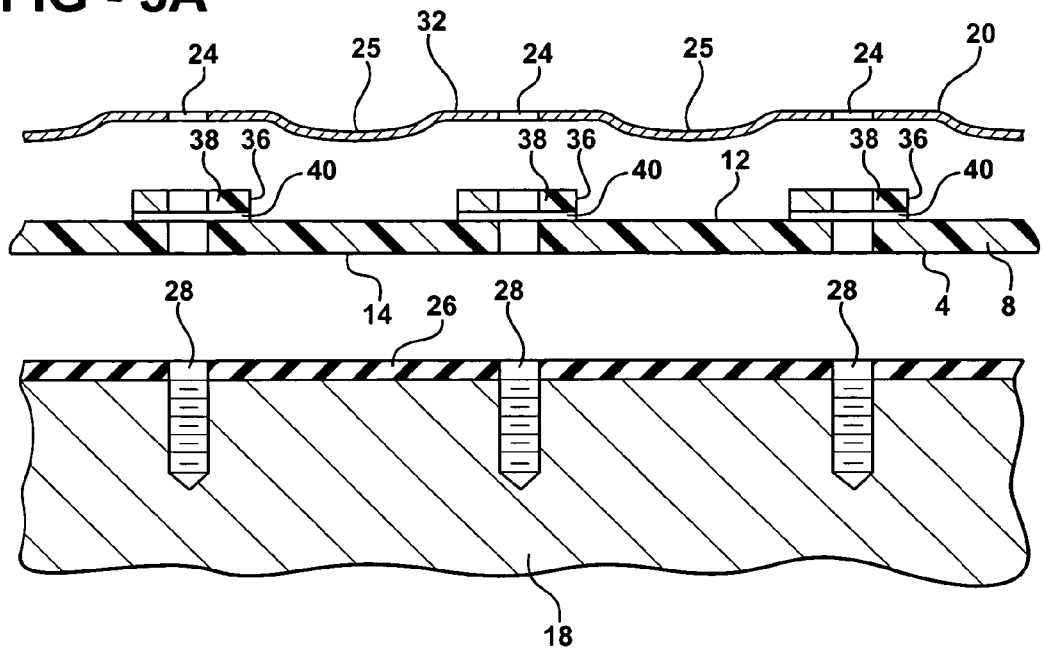
FIG. 5A is an exploded section view of a third embodiment of flanged cover and spring assembly of the present invention.
Figure 5B:
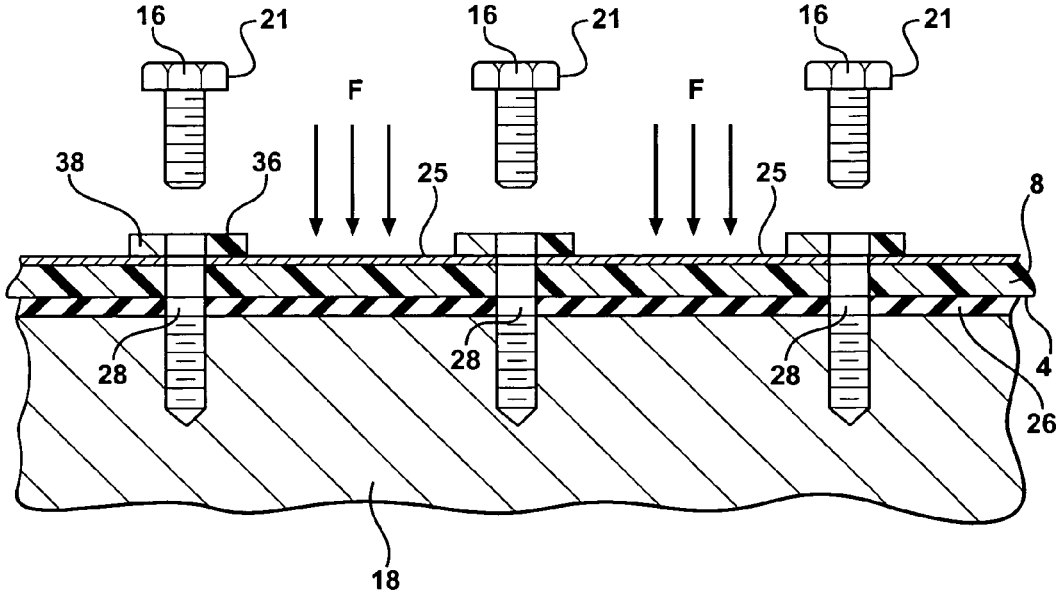
FIG. 5B is a partially assembled section view of the elements of FIG. 5A.

FIGS. 5A and 5B illustrate a third embodiment of the invention. FIG. 5A shows the cover assembly elements in the unassembled condition. FIG. 5B shows the cover assembly elements in the partially assembled condition. In this embodiment, cover 4 includes a plurality of spring retention features 36. Spring retention features 36 are in the form of spring bore bosses 38 having a corresponding plurality of lateral slots 40 that are adapted to receive and retain the spring elements 32. Spring bore bosses 38 and lateral slots 40 are designed to retain spring elements 32 with spring portions 25 compressed against lateral attachment flange 8 as shown in FIG. 5B. Thus, in this embodiment, bolts are not used to compress spring portions 26. This embodiment has the advantage of permitting the preassembly of the spring elements to the cover.

Figure 6A:
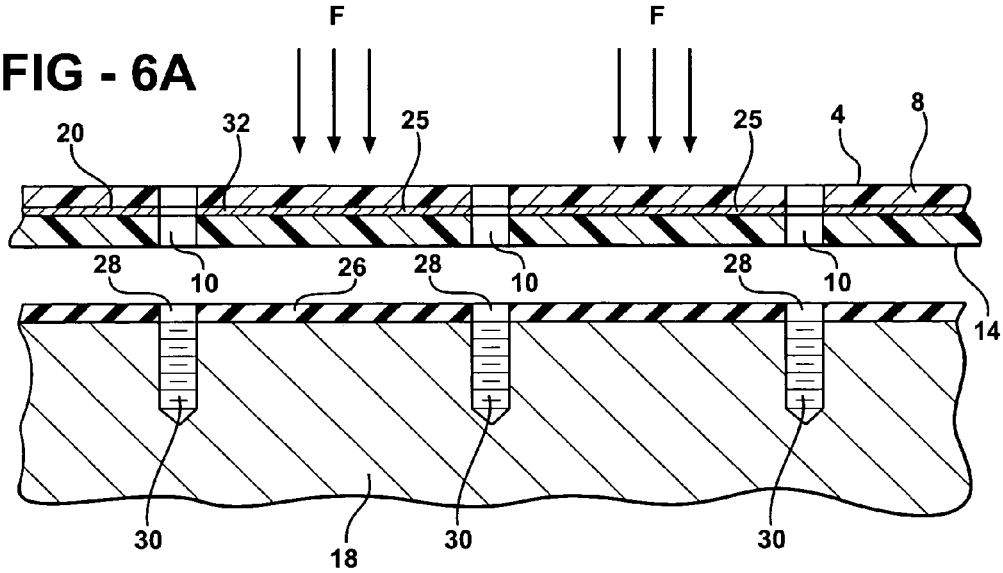
FIG. 6A is an exploded section view of a fourth embodiment of an assembly of the present invention.
Figure 6B:
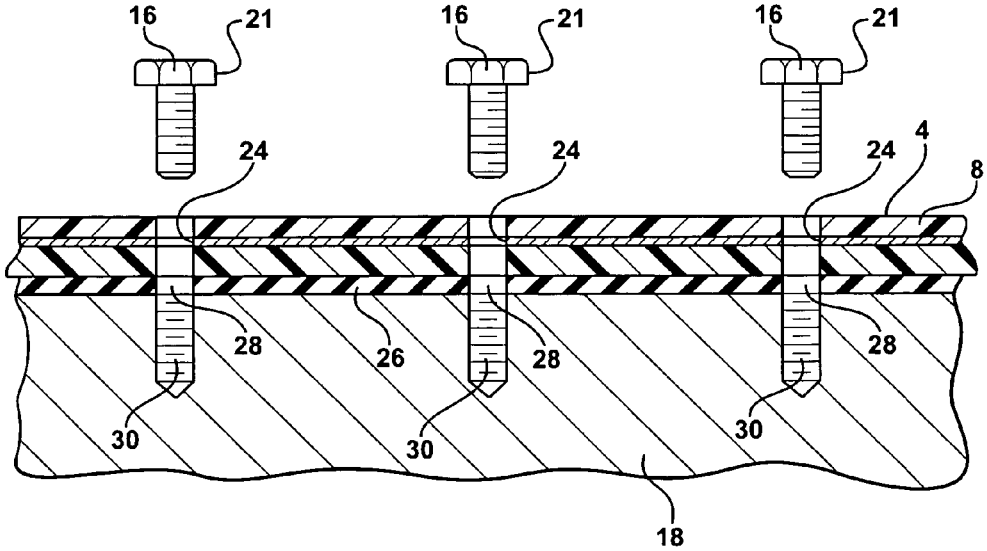
FIG. 6B is a partially assembled section view of the elements of FIG. 6A.

FIGS. 6A and 6B illustrate a fourth embodiment of the invention. FIG. 6A shows the cover assembly elements in the unassembled condition. FIG. 6B shows the cover assembly elements in the partially assembled condition. In this embodiment, spring portions 25 of spring elements 20 are precompressed and molded into lateral attachment flange 8 of cover 6. The precompressed springs exert spring force within a mid-plane within lateral attachment flange 8 and produce an internal stress within the flange that is greater at the locations between the flange bores and lesser at the flange bores. While the distribution of the spring force within the flange is not identical to that which results when the spring force is applied to the upper surface 12 of the flange, this distribution of the spring force would act to resist or prevent warping in the flange, and to make the sealing pressure more uniform along the perimeter of the seal.

Figure 7A:
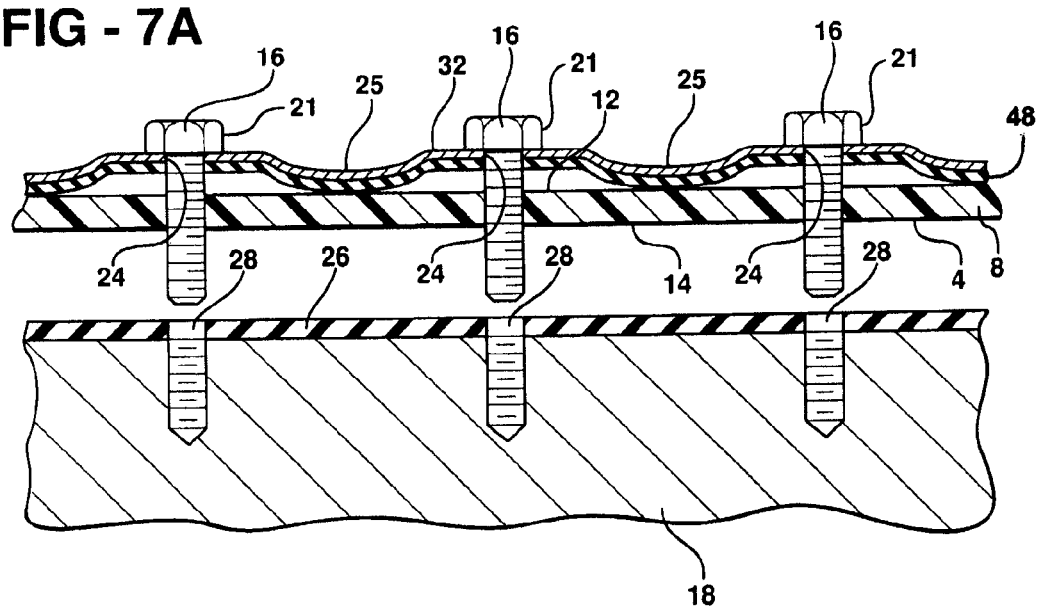
FIG. 7A is an exploded view of a fifth embodiment of an assembly of the present invention.
Figure 7B:
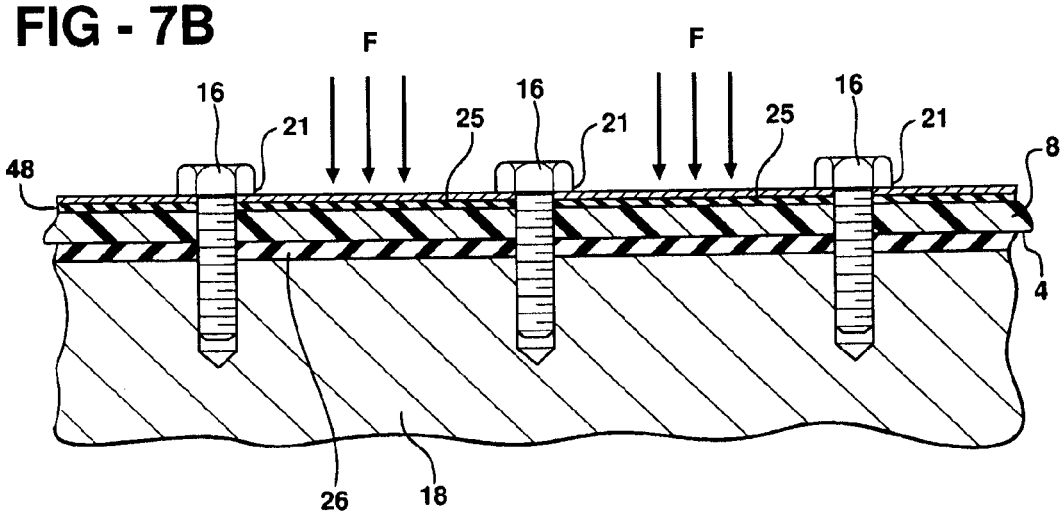
FIG. 7B is an assembled section view of the elements of FIG. 7A.

FIGS. 7A and 7B illustrate another embodiment of the invention. FIG. 7A shows the cover assembly elements in the unassembled condition. FIG. 7B shows the cover assembly elements in the assembled condition. This embodiment is similar to the embodiment illustrated in FIGS. 3A and 3B, but including an elastomer layer 48 that is incorporated between spring element 20 and attachment flange 8. Elastomer layer 48 may be bonded to spring element 20, but may alternately be incorporated as a discrete element or layer. Elastomer layer 48 may comprise a natural or synthetic rubber, but any elastomer compatible with the intended application and application environment may be used. Elastomer layer 48 provides vibration damping between spring element 20 and attachment flange 8. Elastomer layer 48 may also be similarly incorporated into any of the other embodiments described herein to similarly provide vibration damping with respect to spring element 20 and flange cover 8.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A cover assembly, comprising:

a cover having a wall portion, a lateral attachment flange surrounding the wall portion extending outwardly therefrom and a plurality of spaced flange bores extending through the flange from a upper surface to a lower surface, the bores adapted to receive a corresponding plurality of fasteners which are adapted to be inserted through the bores and secure the cover to a base;

a spring retainer which is adapted to extend along at least a portion of the outer surface of the lateral attachment flange, said spring retainer having a plurality of spaced retainer bores corresponding to at least two of the spaced flange bores and at least one shaped spring portion that is adapted to contact the upper surface of the lateral attachment flange mediate the spaced flange bores, and a cover gasket having a plurality of bores corresponding to the plurality of spaced flange bores and spaced retainer bores, wherein the shaped spring portion is adapted to apply a spring force to the upper surface of the lateral attachment flange when the fasteners are inserted through the plurality of spaced retainer bores and the plurality of spaced flange bores and used to secure the cover and the gasket to the base.

2. The cover assembly of claim 1, wherein the cover is a plastic cover.

3. The cover assembly of claim 1, wherein the spring retainer comprises a spring steel.

4. The cover assembly of claim 3, wherein the spring retainer is selected from a group consisting of steel sheet and steel rod.

5. The cover assembly of claim 1, wherein the cover is a valve cover for an internal combustion engine.

6. The valve cover assembly of claim 5, wherein the valve cover is formed from a material selected from a group consisting of an engineering thermoplastic material and an engineering thermoset material.

7. The cover assembly of claim 6, wherein the spring retainer comprises a spring steel.

8. The cover assembly of claim 7, wherein the spring retainer is selected from a group consisting of steel sheet and steel rod.

9. The cover assembly of claim 1, wherein the cover has a plurality of lateral slots formed in spring retention bosses which are adapted to retain the spring portion of the spring retainer in compression against the upper surface of the lateral attachment flange.

10. The cover assembly of claim 1, wherein said spring retainer also has a plurality of drive stops, wherein the drive stops are adapted to limit travel of the fasteners and the spring force applied to the upper surface of said lateral attachment flange.

11. The cover assembly of claim 1, further comprising an elastomer layer located between said spring retainer and the upper surface of said lateral attachment flange.

12. The cover assembly of claim 11, wherein said elastomer layer is bonded to said spring retainer.

13. A cover assembly, comprising:

a cover having a wall portion, a lateral attachment flange surrounding the wall portion and extending outwardly therefrom having a upper surface and a lower surface, a plurality of spaced bosses proximate the upper surface of the lateral attachment flange having a corresponding plurality of lateral slots formed therein, and a corresponding plurality of spaced flange bores extending through the bosses and the flange, the spaced flange bores adapted to receive a corresponding plurality of fasteners which are adapted to be inserted through the bores and secure the cover to a base; and a spring retainer which is adapted to extend along at least a portion of the outer surface of the lateral attachment flange, said spring retainer having a plurality of spaced retainer bores corresponding to at least two of the spaced flange bores and at least one shaped spring portion that is adapted to contact the upper surface of the lateral attachment flange mediate the spaced flange bores, wherein the shaped spring portion is adapted to apply a spring force to the upper surface of the lateral attachment flange when said spring retainer is inserted into the lateral slots of the bosses.

14. The cover assembly of claim 13, wherein the cover is a plastic cover.

15. The cover assembly of claim 13, wherein the spring retainer comprises a spring steel.

16. The cover assembly of claim 15, wherein the spring retainer is selected from a group consisting of steel sheet and steel rod.

17. The cover assembly of claim 13, wherein the cover is a valve cover for an internal combustion engine.

18. The valve cover assembly of claim 17, wherein the valve cover is formed from a material selected from a group consisting of an engineering thermoplastic material and an engineering thermoset material.

19. The cover assembly of claim 18, wherein the spring retainer comprises a spring steel.

20. The cover assembly of claim 19, wherein the spring retainer is selected from a group consisting of steel sheet and steel rod.

21. The cover assembly of claim 13, further comprising an elastomer layer located between said spring retainer and the upper surface of said lateral attachment flange.

22. The cover assembly of claim 21, wherein said elastomer layer is bonded to said spring retainer.

23. A cover assembly, comprising:

a cover having a wall portion, a lateral attachment flange surrounding the wall portion extending outwardly therefrom and a plurality of spaced flange bores extending through the flange from a upper surface to a lower surface, the bores adapted to receive a corresponding plurality of fasteners which are adapted to be inserted through the bores and secure the cover to a base;

a compressed spring which is precompressed and molded into the lateral attachment flange to provide an internal stress within the flange, wherein the internal stress profile is larger at locations mediate the spaced flange bores than at locations proximate the flange bores, and a cover gasket having a plurality of bores corresponding to the plurality of spaced flange bores and spaced retainer bores, wherein the compressed spring applies a spring force to the cover gasket when the fasteners are inserted through the plurality of spaced retainer bores and the plurality of spaced flange bores and fastened to the base.

24. The cover assembly of claim 23, wherein the cover is a valve cover for an internal combustion engine.

25. The valve cover assembly of claim 24, wherein the valve cover is formed from a material selected from a group consisting of an engineering thermoplastic material and an engineering thermoset material.

26. The cover assembly of claim 25, wherein the spring retainer comprises a spring steel.

27. The cover assembly of claim 26, wherein the spring retainer is selected from a group consisting of steel sheet and steel rod.

* * * * *